US005461996A

United States Patent [19]

Kaju

[11] Patent Number: 5,461,996

[45] **Date of Patent: * Oct. 31, 1995**

[54] TUFTING MACHINE AND METHOD FOR PRODUCING TUFTED DESIGN IN CARPETING AND PRODUCT WITH TUFTED DESIGN

[75] Inventor: Sadayoshi Kaju, Osaka, Japan

[73] Assignee: Ohno Co., Ltd., Sakai, Japan

[ * ] Notice: The portion of the term of this patent subsequent to Feb. 28, 2012, has been disclaimed.

[21] Appl. No.: 171,655

[22] Filed: Dec. 22, 1993

Related U.S. Application Data

[63] Continuation-in-part of Ser. No. 61,819, May 13, 1993, abandoned, which is a continuation of Ser. No. 983,096, Nov. 27, 1992, abandoned, which is a continuation of Ser. No. 676,208, Mar. 27, 1991, abandoned.

[30] Foreign Application Priority Data

Apr. 13, 1990 [JP] Japan ..... 2-97842

[51] Int. Cl.[6] ..... D05C 15/14; D05C 15/10

[52] U.S. Cl. ..... 112/80.3; 112/80.43; 112/80.41; 112/80.23; 112/475.23; 112/475.19

[58] Field of Search ..... 112/80.43, 80.3, 112/80.41, 80.55, 80.01, 80.23, 266.2, 410

[56] References Cited

U.S. PATENT DOCUMENTS

| | | | |
|---|---|---|---|
| 3,547,058 | 12/1970 | Wembley et al. . | |
| 3,934,524 | 1/1976 | Smith | 112/80.3 X |
| 4,244,309 | 1/1981 | Spanel et al. . | |
| 4,549,496 | 10/1985 | Kile . | |
| 4,831,948 | 5/1989 | Itoh et al. | 112/80.43 |

FOREIGN PATENT DOCUMENTS

| | | |
|---|---|---|
| 53612 | 12/1990 | Australia . |
| 3028413 | 3/1981 | Germany . |
| 3811330 | 12/1988 | Germany . |
| 526669 | 9/1972 | Switzerland . |
| 1178534 | 1/1970 | United Kingdom . |
| 1503352 | 3/1978 | United Kingdom . |
| 2052101 | 1/1981 | United Kingdom . |
| 2061336 | 5/1981 | United Kingdom . |
| 89/09300 | 10/1989 | WIPO . |

OTHER PUBLICATIONS

Trade Journal "Focus", Aug./Sep. 1993, pp. 4–5, 40–41 and 46–47 including cover and bottom pages.

*Primary Examiner*—Clifford D. Crowder
*Assistant Examiner*—Paul C. Lewis
*Attorney, Agent, or Firm*—Darby & Darby

[57] ABSTRACT

A tufting machine and method of tufting on a backing fabric, where the machine for carrying out the method includes a needle push bar, loopers, a needle selector for selecting certain ones of the needles at every needle stroke cycle and for inserting the selected needles into the backing fabric, a feeder for intermittently and longitudinally feeding the backing fabric in a stop and feed manner, a shifter and a pattern controller. The backing fabric remains stationary in the longitudinal direction during a stopping period which is at least one needle stroke cycle in duration and may be fed during a succeeding feeding stroke period. The shifter aligns selected ones of the needles each with any one of an associated plurality of the loopers by effecting relative lateral shifting movement between the needle push bar and both the loopers and the backing fabric while the backing fabric remains stationary in the longitudinal direction during the stopping period. The pattern controller actuates the needle selector to select any one of the needles for insertion into the backing fabric and tufts with the pile yarn carried by the selected one of the needles by engagement with a corresponding one of the loopers that is disposed in alignment therewith. In this manner, the corresponding one of the loopers seizes only one loop of the pile yarn during any one needle stroke cycle for each stopping period of the intermittent feeder.

12 Claims, 6 Drawing Sheets

TUFTING MACHINE AND METHOD FOR PRODUCING TUFTED DESIGN IN CARPETING AND PRODUCT WITH TUFTED DESIGN

CROSS-REFERENCE TO COPENDING APPLICATIONS

This is a continuation-in-part of U.S. Ser. No. 08/061,819, filed May 13, 1993 now abandoned, which is in turn a continuation of U.S. Ser. No. 07/983,096, filed Nov. 27, 1992 now abandoned which is in turn a continuation of U.S. Ser. No. 07/676,208, filed Mar. 27, 1991 now abandoned.

BACKGROUND OF THE INVENTION

The present invention relates to a machine and method for producing design in carpeting and to the produced design in carpeting. The contents of U.S. Ser. No. 07/676,208, which describes a tufting machine and a method for producing a design in carpeting, is incorporated herein by reference. Operative modes of that described machine are set forth in further detail in this application and the tufted design in carpeting that is produced from that machine will be further described.

SUMMARY OF THE INVENTION

The present invention is directed to a tufting machine and method of tufting on a backing fabric. The machine includes a needle push bar having a plurality of laterally aligned needles separated from each other by spacings of substantially equal distance each arranged for carrying pile yarn when selected, a plurality of laterally spaced loopers separated from each other by said spacings of equal distance, needle select means for selecting certain ones of said needles at every needle stroke cycle and for inserting said selected needles into the backing fabric, feed means for intermittently and longitudinally feeding said backing fabric in a stop and feed manner wherein said backing fabric remains stationary in the longitudinal direction during a stopping period which is at least one needle stroke cycle in duration and may be fed during a succeeding feeding stroke period, shift means adapted to shift said needles laterally a distance equivalent to a needle gauge in every needle stroke cycle for aligning said selected ones of said needles each with any one of an associated plurality of said loopers by effecting relative lateral shifting movement between said needles and both of said loopers and said backing fabric while said backing fabric remains stationary in the longitudinal direction during said stopping period, and pattern control means for actuating said needle select means to select any one of the needles for insertion into the backing fabric and for tufting with the pile yarn carded by the selected one of the needles by engagement with a corresponding one of the loopers that is disposed in alignment therewith such that said corresponding one of the loopers seizes only one loop of the pile yarn during any one needle stroke cycle for each stopping period of the stop and feed manner of said feed means.

The tufting method includes the 1st step of threading pile yarns colored in different color into needles in a manner wherein said pile yarn are composed of several sets of different colors and divided into several groups each of which is respectively composed of several pile yarn classified by colors the number of which is equivalent to the number of said sets of pile yarn, said pile yarns of each group are arranged in order of said difference of their color in a manner wherein the arrangement of each group is similar to one another, and said arranged pile yarn are respectively threaded into the corresponding needles laterally aligned at the same gauge according to said order of their arrangement in each group, the 2nd step of adjusting the number of said needle stroke cycle of each periodic time of a stop and feed motion of said intermittent feed means to be fixed so that said number of said needle stroke cycles of each periodic time becomes equivalent to that of sets of pile yarn, and the 3rd step (of tufting being carried oat manner) wherein said pattern control means provides said needle select means with a signal adapted to actuate every looper to seize only one loop of pile yarn from any one of said needles laterally shifted and disposed over said looper for seizing only one loop of pile yarn in each periodic time of a stop and feed motion of said intermittent means.

DESCRIPTION OF THE PREFERRED EMBODIMENT

Figure 1:
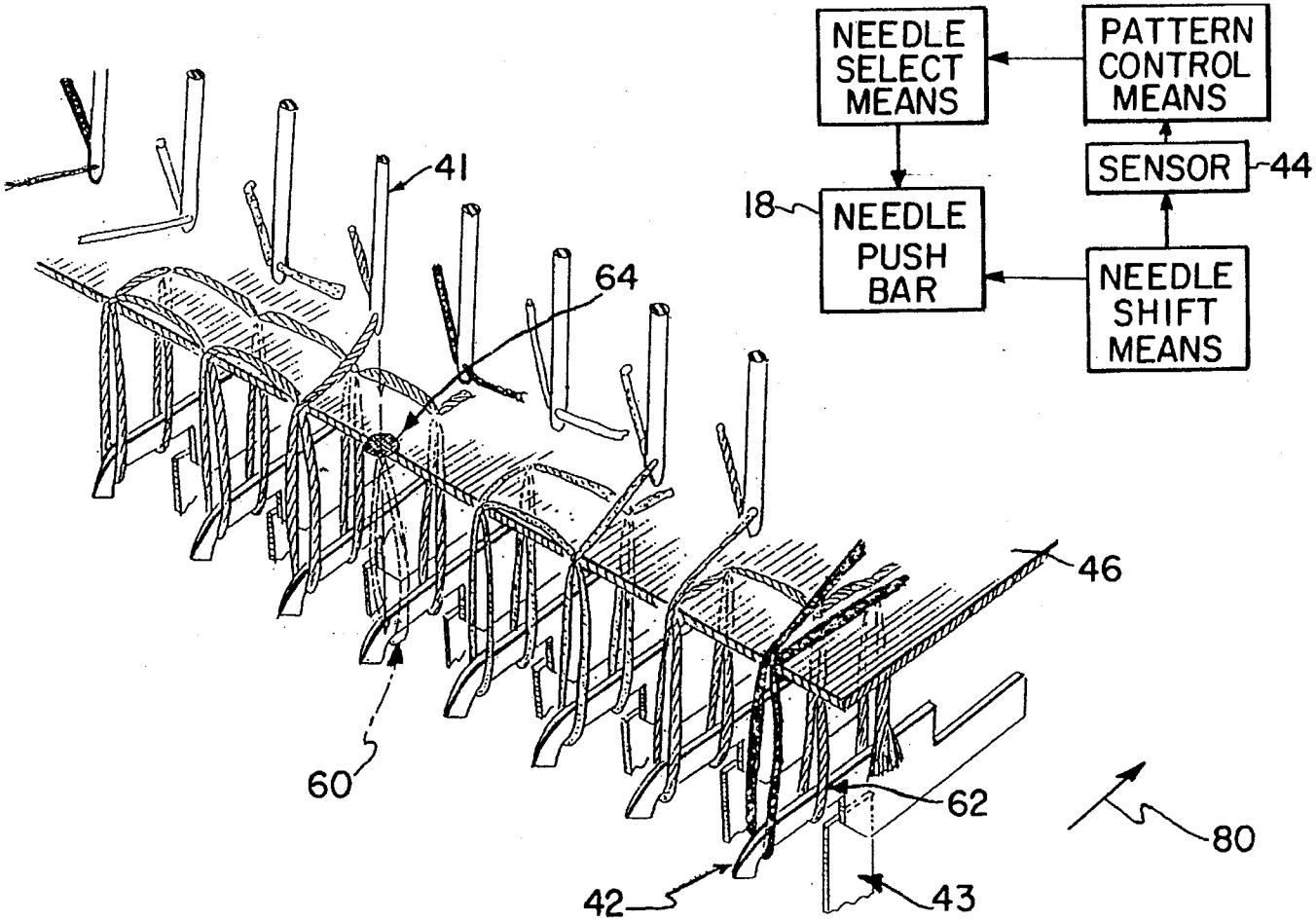
FIG. 1 is a perspective view of tufting in accordance with the present invention.

Referring to the drawings, FIG. 1 illustrates tufting in accordance with the present invention. The backing fabric 46 is not moved until the last pile 60 in the lateral direction is tufted so that the needle gauges from adjacent pries tufted by other needles, which are mounted together with the needle which tufts the last pile 60 on the same needle push bar 18, are accurately adjusted in the same gauge with other piles previously tufted. After the last pile 60 is tufted, all piles are moved at the same time in the longitudinal direction by the movement of the backing fabric 46 relative to the needle push bar 18. In this manner, the stitch gauges from adjacent piles, which were rafted during the last stopping period of the backing fabric and which will be rafted during the next stopping period, are accurately adjusted in the same gauge.

Especially for the case where cut piles are formed by cutting with a knife 43, the backing fabric 46 is securely held by the loopers 42 through the pile-loop-yarn 62 since each looper keeps seizing at least one pile-loop-yarn which was seized during the last stopping period. As a consequence, the portion 64 where the last pile 60 is to be rafted is kept stationary until the last pile is tufted on that portion. In such a manner, both the needle and stitch gauges between the last. pile and adjacent piles are accurately adjusted.

Also shown schematically in FIG. 1 is the needle push bar 18, needle select means, pattern control means, sensor 44 for sensing the needle shift position, and the needle shift means. These components are further described in U.S. Ser. No. 07/672,208 and so such a description need not be repeated here.

The manner in which a desired fabric pattern is produced will now be described with reference to the progressive views of FIGS. 2*a*–2*d*, 3*a*–3*d*, 4*a*–4*d* and 5*a*–5*d* which depict the steps involved in tufting in accordance with the invention during the intermittent stopping of the backing fabric 46. In each figure, the sixteen needles shown are numbered from left to fight in succession as 1*aad*, 2*a*–2*d*, 3*a*–3*d*, 4*a*–4*d*. The thirteen loopers shown are designated from left to fight in succession as a-m.

Figure 2D:
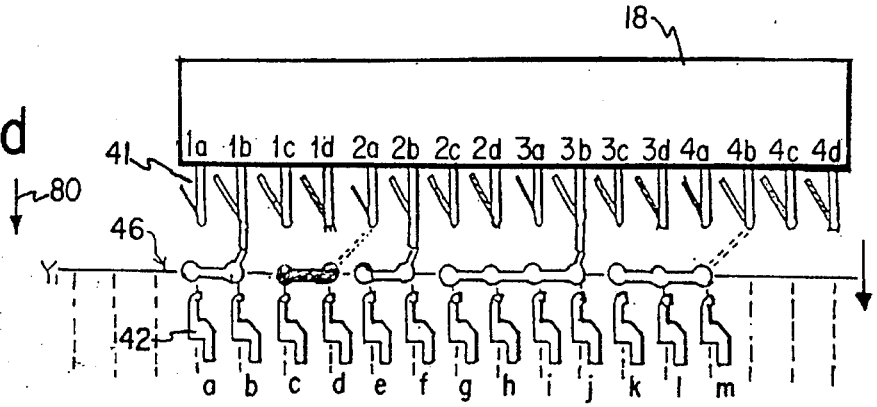
FIGS. 2*a*–2*d* are progressive views showing the relative positions of the needles and loopers during a first periodic time of a stop and feed motion of a fabric being tufted.
Figure 2C:
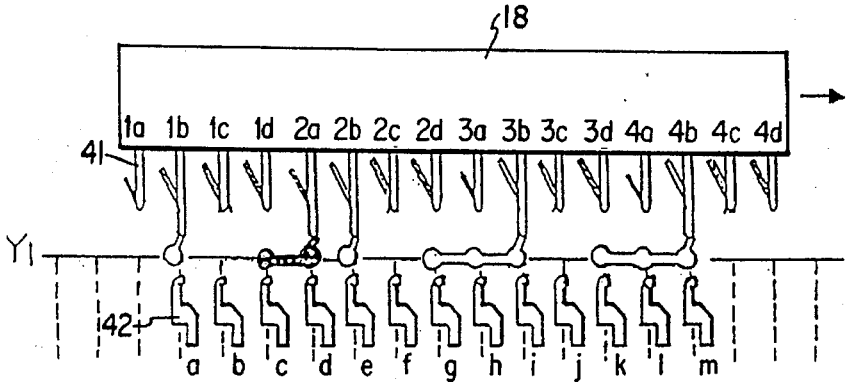
Figure 2B:
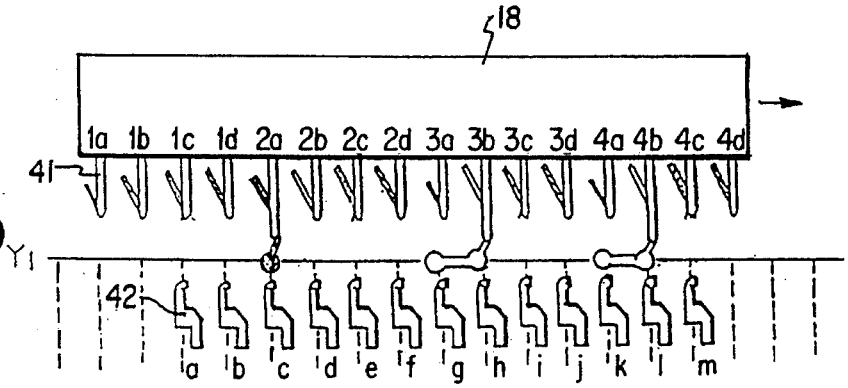
Figure 2A:
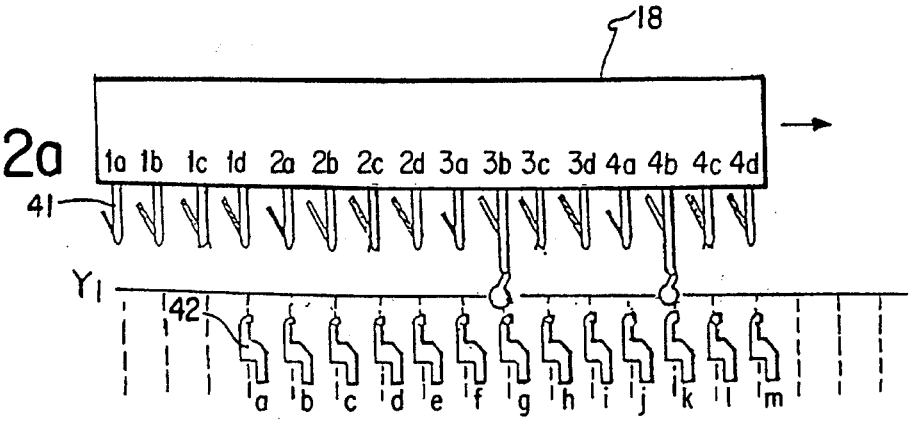

The grid consists of intersecting horizontal rows and vertical columns. For sake of clarity, the loopers are shown spaced from the needles. In operation, however, the loopers are always disposed under the needle for each stitch. This means that the loopers would be under the horizontal mw that is being stitched with the needles for a particular needle stroke cycle. For instance, if the grid is considered representative of the fabric, the needle push bar is elevated above it and the loopers are beneath the fabric. The needles are operated to move downwardly to effect a stitch in the fabric. The fabric feeding direction is in the direction of the fabric feeding arrow 80. FIGS. 2*a*–2*d* correspond to four respective steps during the first periodic time Y1 of the stop-feed motion. The steps are:

First Step:

In the 1st needle stroke cycle of 1st periodic time Y1 (FIG. 2*a*)

(1) needles 3*b* and 4*b* are selected to tuft, and (2) loopers (g) and (k) seize respectively one pile yarn (3) after tufting, the needle push bar 18 moves to the right by one needle gauge.

Second Step:

In the 2nd needle stroke cycle of 1st periodic time Y1 (FIG. 2*b*)

(1) needles 2*a*, 3*b* and 4*b* are selected to tuft, and (2) loopers (c), (h) and (1) seize respectively one pile yarn (3) after tufting, the needle push bar 18 moves to the right by one needle gauge.

Third Step:

In the 3rd needle stroke cycle of 1st periodic time Y1 (FIG. 2*c*)

(1) needles 1*b*, 2*a*, 2*b*, 3*b* and 4*b* are selected to tuft, and (2) loopers (a), (d), (e), (i) and (m) seize respectively one pile yarn (3) after tufting, the needle push bar 18 moves to the right by one needle gauge.

Fourth Step:

In the 4th needle stroke cycle of 1st periodic time Y1 (FIG. 2*d*)

(1) needles 1*b*, 2*b* and 3*b* are selected to tuft, and (2) loopers (b) , (f) and (j) seize respectively one pile yarn (3) after tufting, the backing fabric moves longitudinally one stitch gauge.

Figure 3D:
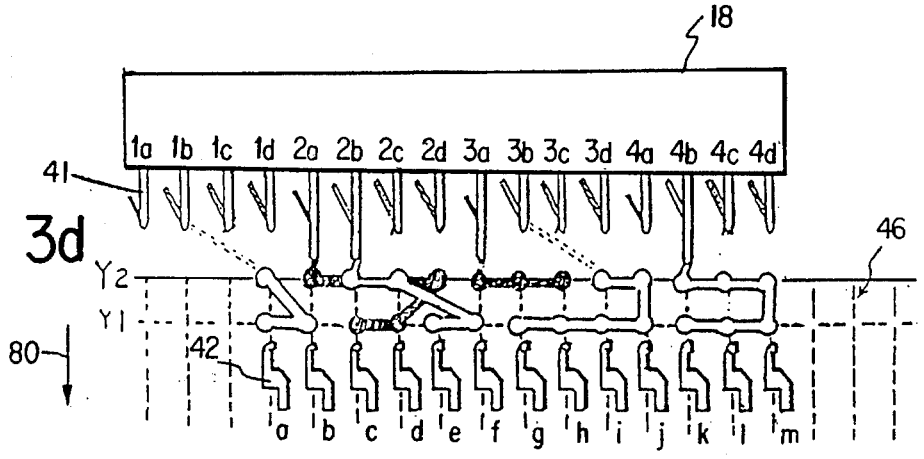
FIGS. 3*a*3*d*are progressive views as in FIGS. 2*a*–2*d*, except shown for an immediately following second periodic time of the stop and feed motion of the fabric being tufted.
Figure 3C:
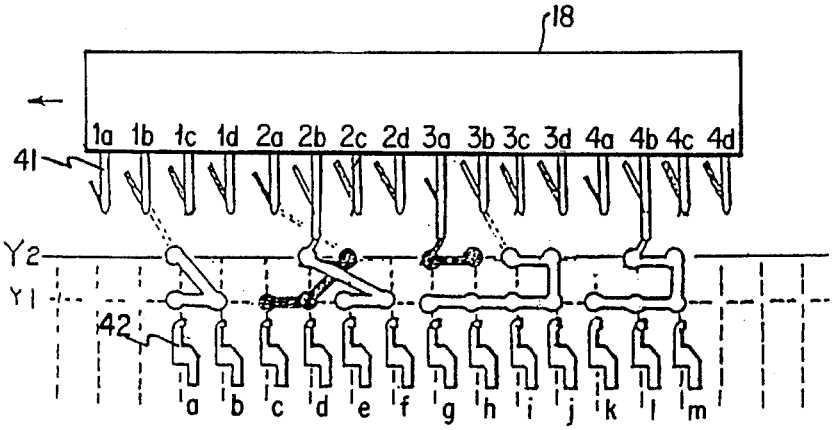
Figure 3B:
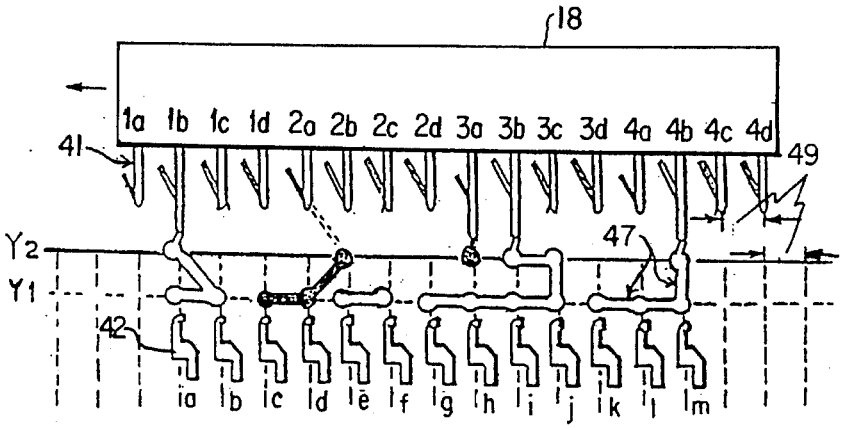
Figure 3A:
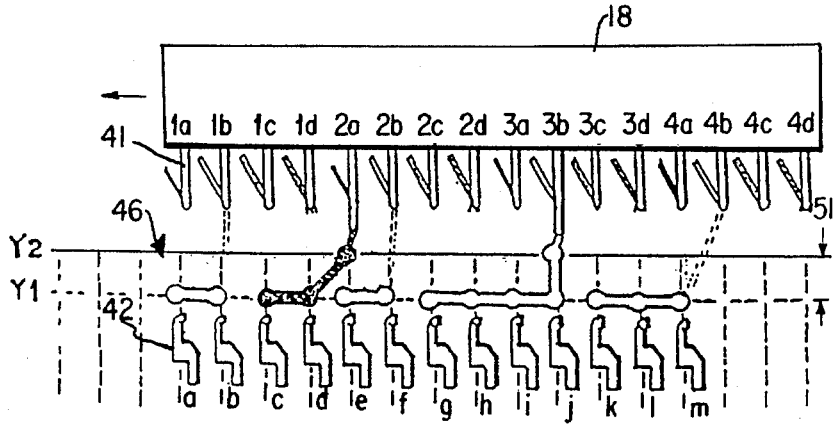

FIGS. 3*a*–3*d* correspond to four respective steps during the second periodic time Y2 of the stop-feed motion, i.e., immediately following the first periodic time Y1. The steps are:

First Step:

In the 1st needle stroke cycle of 2nd periodic time Y2 (FIG. 3*a*)

(1) needles 2*a* and 3*b* are selected to tuft, and (2) loopers (e) and (j) seize respectively one pile yarn (3) after tufting, the needle push bar 18 moves to the left by one needle gauge. The stitch gauge 51 is indicated in FIG. 3*a*.

Second Step:

In the 2nd needle stroke cycle of 2nd periodic time Y2 (FIG. 3*b*)

(1) needles 1*b*, 3*a*, 3*b* and 4*b* are selected to tuft, and (2) loopers (a), (h) (i) and (m) seize respectively one pile yarn (3) after tufting, the needle push bar 18 moves to left by one needle gauge 49. As can be seen in FIG. 3*b*, a back stitch 47 forms.

Third Step:

In the 3rd needle stroke cycle of 2nd periodic time Y2 (FIG. 3*c*)

(1) needles 2*b*, 3*a* and 4*b* are selected to tuft, and (2) loopers (d) , (g) and (1) seize respectively one pile yarn (3) after tufting, the needle push bar 18 moves to the left by one needle gauge.

Fourth Step:

In the 4th needle stroke cycle of 2nd periodic time Y2 (FIG. 3*d*)

(1) needles 2*a*, 2*b*, 3*a* and 4*b* are selected to tuft, and (2) loopers (b), (c), (f) and (k) seize respectively one pile yarn (3) after tufting, the backing fabric moves longitudinally one stitch gauge.

Figure 4D:
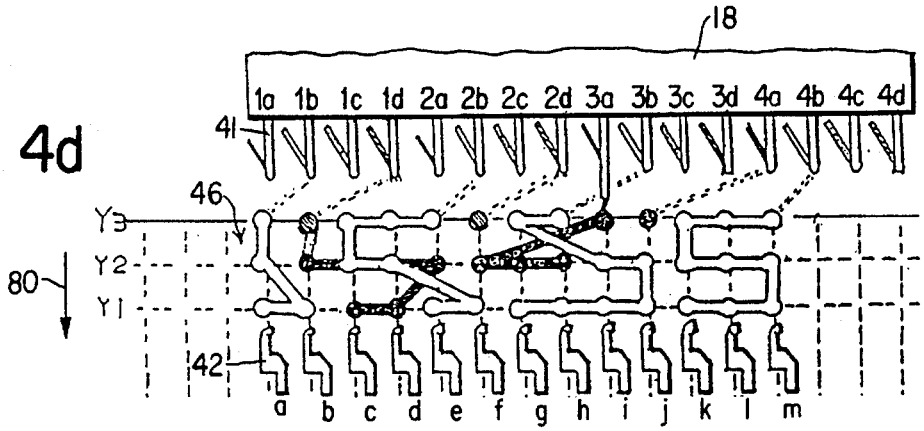
FIGS. 4*a*–4*d* are progressive views as in FIGS. 3*a*–3*d*, except shown for an immediately following third periodic time of the stop and feed motion of the fabric being tufted.
Figure 4C:
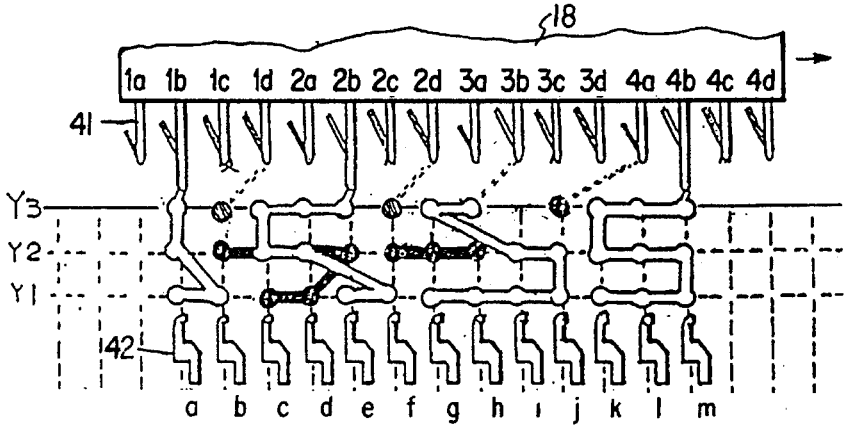
Figure 4B:
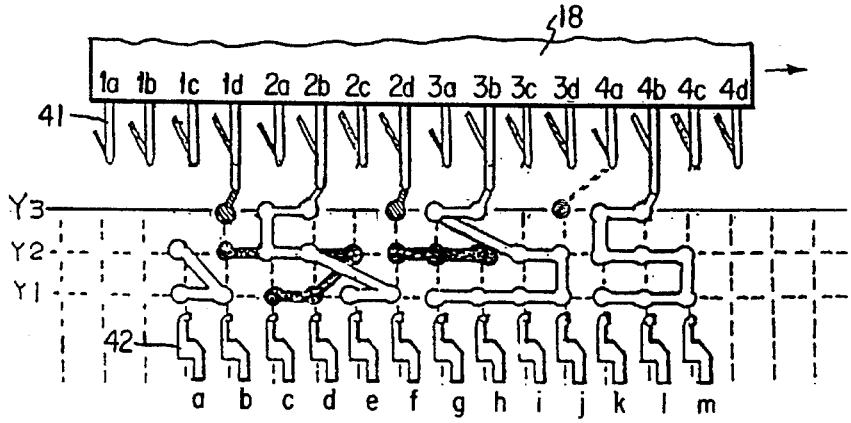
Figure 4A:
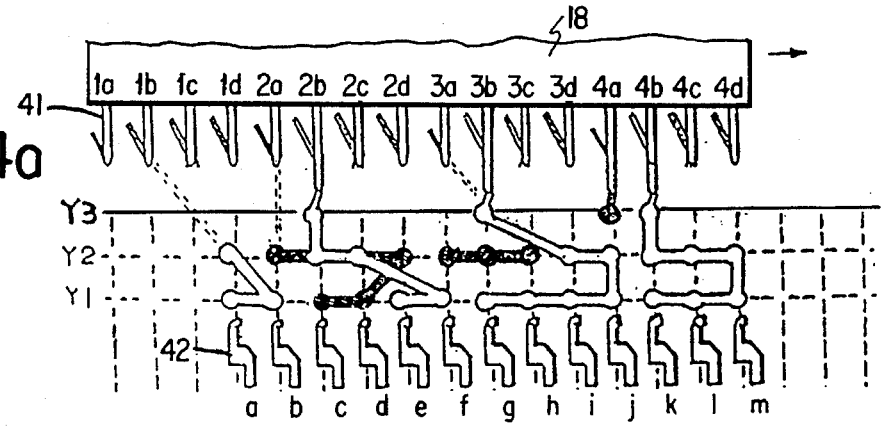

FIGS. 4*a*–4*d* correspond to four respective steps during the third periodic time Y3 of the stop-feed motion, i.e., immediately following the second periodic time Y2. The steps are:

First Step:

In the 1st needle stroke cycle of 3rd periodic time Y3 (FIG. 4*a*)

(1) needles 2*b*, 3*b*, 4*a* and 4*b* are selected to tuft, and (2) loopers (c), (g), (j) and (k) seize respectively one pile yarn (3) after tufting, the needle push bar 18 moves to the right by one needle gauge.

Second Step:

In the 2nd needle stroke cycle of 3rd periodic time Y3 (FIG. 4*b*)

(1) needles 1*d*, 2*b*, 2*d*, 3*b* and 4*b* are selected to tuft, and (2) loopers (b), (d), (f), (h) and (1) seize respectively one pile yarn (3) after tufting, the needle push bar 18 moves to the right by one needle gauge.

Third Step:

In the 3rd needle stroke cycle of 3rd periodic time Y3 (FIG. 4*c*)

(1) needles 1*b*, 2*b*and 4*b* are selected to tuft, and (2) loopers (a), (e) and (m) seize respectively one pile yarn (3) after tufting, the needle push bar 18 moves to the right by one needle gauge.

Fourth Step:

In the 4th needle stroke cycle of 3rd periodic time Y3 (FIG. 4*d*)

(1) needles 3*a*is selected to tuft, and (2) loopers (i) seizes respectively one pile yarn (3) after tufting, the backing fabric moves longitudinally one stitch gauge.

FIGS. 5a–5d correspond to four respective steps during the fourth periodic time Y4 of the stop-feed motion, i.e., immediately following the third periodic time Y3. The steps are:

First Step:

In the 1st needle stroke cycle of 4th periodic time Y4 (FIG. 4a)

(1) needle 4a is selected to tuft, and (2) looper (m) seizes respectively one pile yarn (3) after tufting, the needle push bar 18 moves to the left by one needle gauge.

Figure 5D:
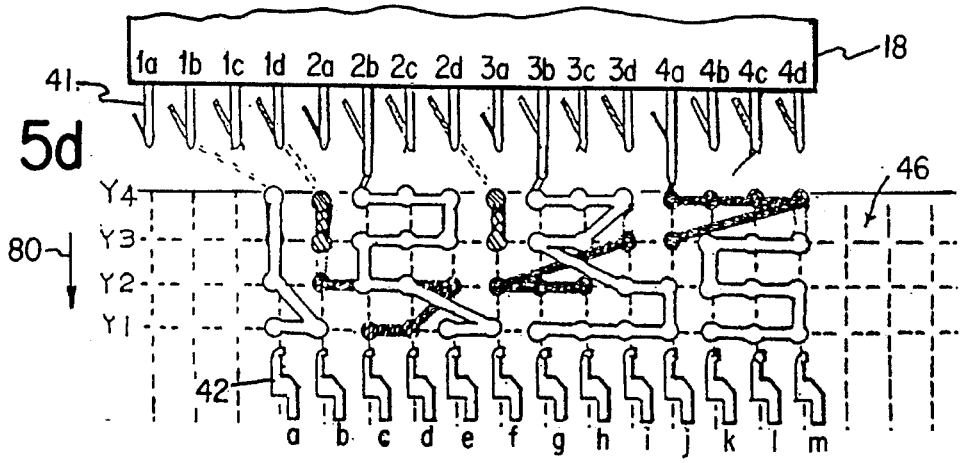
FIGS. 5*a*–5*d* are progressive views as in FIGS. 4*a*–4*d*, except shown for an immediately following fourth periodic time of the stop and feed motion of the fabric being tufted.
Figure 5C:
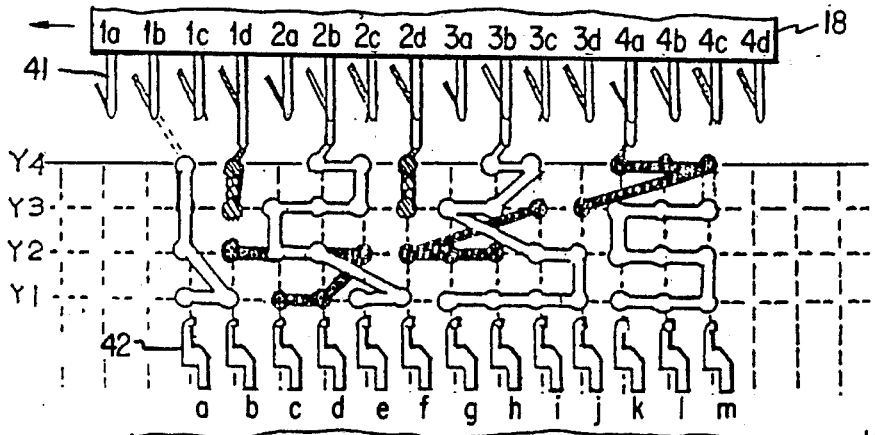
Figure 5B:
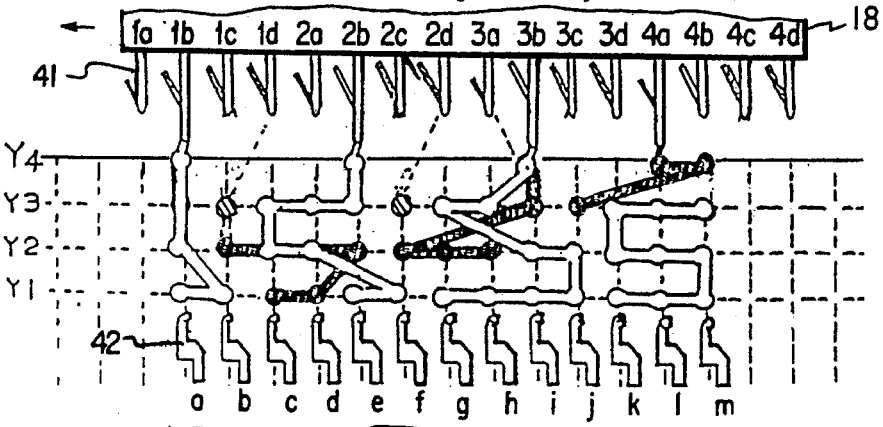
Figure 5A:
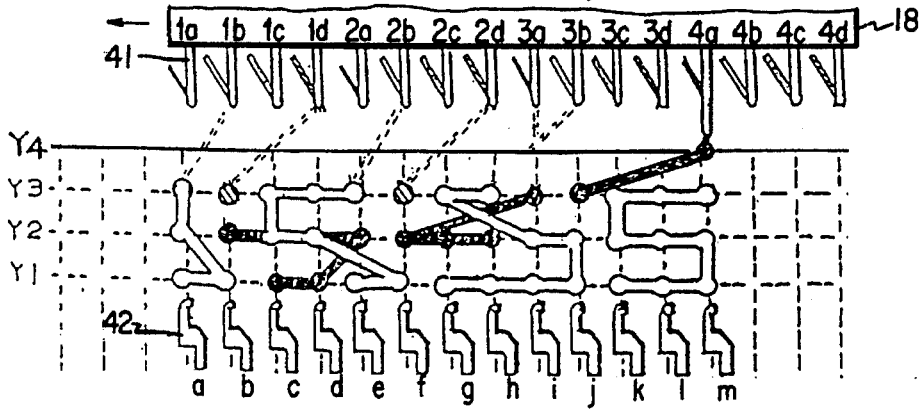

Second Step:

In the 2nd needle stroke cycle of 4th periodic time Y4 (FIG. 5b)

(1) needles 1b, 2b, 3b and 4a are selected to tuft, and (2) loopers (a) , (e) , (i) and (1) seize respectively one pile yarn (3) after tufting, the needle push bar 18 moves to the left by one needle gauge.

Third Step:

In the 3rd needle stroke cycle of 4th periodic time Y4 (FIG. 5c)

(1) needles 1d, 2b, 2d, 3b and 4a are selected to tuft, and (2) loopers (b), (d), (f), (h) and (k) seize respectively one pile yarn (3) after tufting, the needle push bar 18 moves to the left by one needle gauge.

Fourth Step:

In the 4th needle stroke cycle of 4th periodic time Y4 (FIG. 5d)

(1) needles 2b, 3b and 4a are selected to tuft, and (2) loopers (c) , (g) and (j) seize respectively one pile yarn (3) after tufting, the backing fabric moves longitudinally one stitch gauge.

Figure 6D:
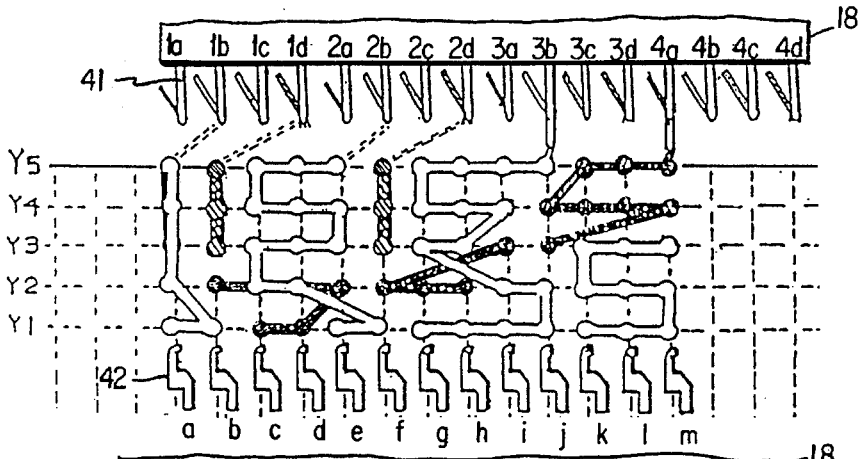
FIGS. 6*a*–6*d* are progressive views as in FIGS. 5*a*–5*d*, except shown for an immediately following fifth periodic time of the stop and feed motion of the fabric being tufted.
Figure 6C:
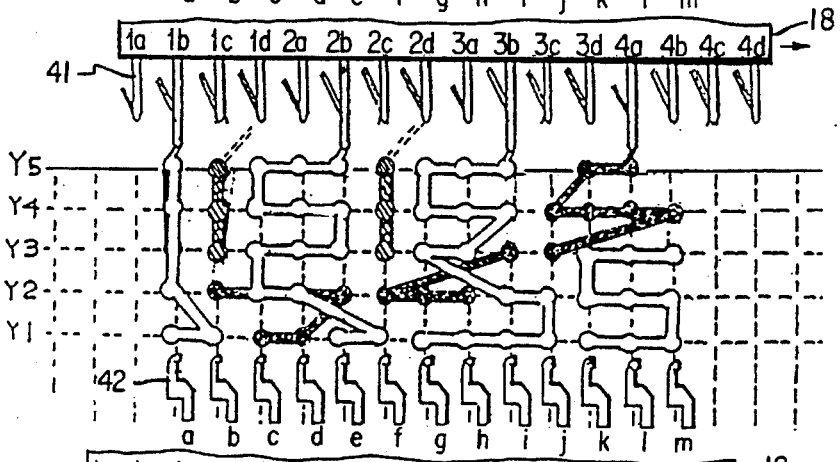
Figure 6B:
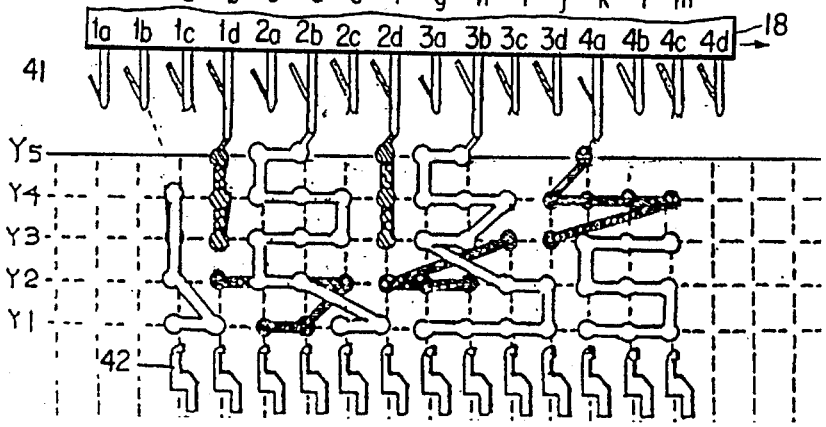
Figure 6A:
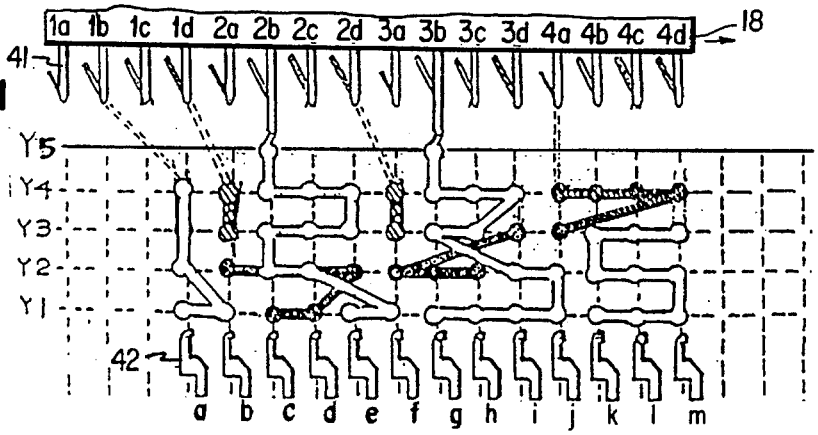

FIGS. 6a–6d correspond to four respective steps during the fifth periodic time Y5 of the stop-feed motion, i.e., immediately following the fourth periodic time Y4. The step s are:

First Step:

In the 1st needle stroke cycle of 5th periodic time Y5 (FIG. 6a)

(1) needles 2band 3b are selected to tuft, and (2) loopers (c) and (g) seize respectively one pile yarn (3) after tufting, the needle push bar 18 moves to the right by one needle gauge.

Second Step:

In the 2nd needle stroke cycle of 5th periodic time Y5 (FIG. 6b)

(1) needles 1d, 2b, 2d, 3b and 4a are selected to tuft, and (2) loopers (b), (d), (f), (h) and (k) seize respectively one pile yarn (3) after tufting, the needle push bar 18 moves to the right by one needle gauge.

Third Step:

In the 3rd needle stroke cycle of 5th periodic time Y5 (FIG. 6c)

(1) needles lb, 2b, 3b and 4a are selected to tuft, and (2) loopers (a), (e), (i) and (1) seize respectively one pile yarn (3) after tufting, the needle push bar 18 moves to the fight by one needle gauge.

Fourth Step:

In the 4th needle stroke cycle of 5 th periodic time Y5 (FIG. 6d)

(1) needles 3b and 4a are selected to tuft, and (2) loopers (j) and (m) seize respectively one pile yarn (3) after tufting, the backing fabric moves longitudinally one stitch gauge.

In one embodiment of the invention, the needles are individually controlled needles (ICN) and may be selected from the needle push bar individually for insertion into the backing fabric. The needle push bar may be laterally shifted to the right or left each time by an integral number of needle gauge intervals. Loopers, which are aligned with the selected needles, seize only one loop of the pile yarn carried by the selected needles. The loopers, therefore, are of a cut-looper type.

There are two general types of loopers; a cut-looper for forming a cut-pile and a loop-looper for forming a loop pile. The cut-looper is mounted as in the present invention by turning its bill in the opposite direction of fabric feeding (which distinguishes over mounting a loop-looper, whose bill is turned in the same direction as the fabric feeding).

Since each cut-looper of the present invention is associated with a respective plurality of selectable adjacent needles, each needle may carry a different color yarn to be seized by its aligned cut-looper. As a result, rafting can be achieved by the ICNs of a single rafting head, which permits production of highly decorative fabrics.

While the foregoing description and drawings represent the preferred embodiments of the present invention, it will be understood that various changes and modifications may be made without departing from the spirit and scope of the present invention.

What is claimed is:

1. A tufting machine for operating on a backing fabric, comprising:

a needle push bar having a plurality of laterally aligned needles separated from each other by spacings of substantially equal distance each arranged for carrying pile yarn when selected;

a plurality of laterally spaced loopers separated from each other by said spacings of substantially equal distance;

needle select means for selecting certain ones of said needles at every needle stroke cycle and for inserting said selected needles into the backing fabric;

feed means for intermittently and longitudinally feeding said backing fabric in a stop and feed manner wherein said backing fabric remains stationary in the longitudinal direction during a stopping period which is at least one needle stroke cycle in duration and may be fed during a succeeding feeding stroke period;

shift means adapted to shift said needles laterally a distance equivalent to a needle gauge in every needle stroke cycle for aligning said selected ones of said needles each with any one of an associated plurality of said loopers by effecting relative lateral shifting movement between said needles and both said loopers and said backing fabric while said backing fabric remains stationary in the longitudinal direction during said stopping period; and pattern control means for actuating said needle select means to select any one of the needles for insertion into the backing fabric and for tufting with the pile yarn carried by the selected one of the needles by engagement with a corresponding one of the loopers that is disposed in alignment therewith such that said corresponding one of the loopers seizes only one loop of the pile yarn during any one needle stroke cycle for each stopping period of the stop and feed manner of said feed means.

2. A machine as in claim 1, wherein said pattern control means directs said associated plurality of needle stroke cycles to be completed during each of a plurality of successive ones of said stopping periods, said feed means feeding said backing fabric longitudinally one stitch gauge only after completion of tufting during a last one of associated plurality of needle stroke cycles for each of said stopping periods.

3. A machine as in claim 2, wherein said pattern control means directs said shift means to effect the relative lateral shifting between said needle push bar and both said loopers and said backing fabric by one needle gauge during each of said needle stroke cycles.

4. A machine as in claim 3, wherein said shift means effects the relative lateral shifting by a distance of a plurality of needle gauges during each of said stopping periods.

5. A machine as in claim 1, wherein said pattern control means includes means for directing a sequence of needle strokes to take place each being carried out with means for selecting needles to tuft, means for seizing one pile yarn with the loopers respectively, means for moving said needle shift bar one needle gauge in a lateral direction relative to a length of the backing fabric, said pattern control means further including means for directing thereafter a needle stroke to take place with said means for selecting needles to tuft, said means for seizing one pile yarn with the loopers respectively, and means for moving the backing fabric longitudinally one stitch gauge.

6. A method of tufting by operating on a backing fabric, comprising the steps of selecting certain ones of a plurality of needles, the needles each being arranged for carrying pile yarn when selected and being provided on a needle push bar, the step of selecting taking place at every needle stroke cycle by inserting the selected needles into the backing fabric;

intermittently and longitudinally feeding the backing fabric in a stop and feed motion wherein said backing fabric remains stationary in the longitudinal direction during a stopping period which is at least one needle stroke cycle in duration and may be fed during a succeeding feeding stroke period;

aligning the selected ones of said needles each with any one of an associated plurality of said loopers by effecting relative lateral shifting movement between said needle push bar and both said loopers and said backing fabric while said backing fabric remains stationary in the longitudinal direction during said stopping period; and activating the step of selecting to select any one of the needles for insertion into the backing fabric and tufting with the pile yarn carried by the selected one of the needles by engagement with a corresponding one of the loopers that is disposed in alignment therewith such that said corresponding one of the loopers seizes only one loop of the pile yarn during any one needle stroke cycle for each stopping period of the stop and feed motion.

7. A method of tufting as in claim 6, further comprising the steps of (1) threading pile yarns colored in different color into needles in a manner wherein:

(a) said pile yarns are composed of several sets of different colors and divided into several groups each of which is respectively composed of several pile yarns classified by colors the number of which is equivalent to the number of said sets of pile yarn, (b) said pile yarns of each group are arranged in order of said difference of their color, and (c) said arranged pile yarns are respectively threaded into the corresponding needles laterally aligned at the same gauge according to said order of their arrangement in each group;

(2) adjusting the number of said needle stroke cycle of each periodic time of the stop and feed motion to be fixed so that said number of said needle stroke cycles of each periodic time becomes equivalent to that of sets of pile yarns; and (3) tufting in a manner wherein a pattern control means provides a needle select means with a signal adapted to actuate every looper to seize only one loop of pile yarn from any one of said needles laterally shifted and disposed over said looper for seizing only one loop of pile yarn in each periodic time of the stop and feed motion of said intermittent means.

8. A tufted product produced in accordance with the method of claim 6.

9. A tufting machine comprising a plurality of laterally aligned needles separated from each other by spacings of substantially equal distance, a plurality of laterally spaced loopers separated from each other by said spacings of equal distance, a needle select means for selecting certain ones of said needles at every needle stroke cycle and for sticking said selected needles into the backing fabric, a pattern control means for providing a signal for actuating said needle select means to select and stick a needle into the backing fabric, an intermittent feed means for intermittently and longitudinally feeding said backing fabric in a stop and feed manner wherein said backing fabric remains stationary in the longitudinal direction during several needle stroke cycles and can be fed in a needle stroke cycle, and a shift means for effecting relative lateral shifting movement between said needles and said backing fabric.

10. A machine according to claim 9 wherein said shift means is adapted to shift said needles laterally a distance equivalent to a needle gauge in every needle stroke cycle while said backing fabric is not fed by said intermittent feed means and remains stationary in the longitudinal direction, and said pattern control means is adapted to provide said needle select means with a signal so that any one of said needles may be selected, stuck, and then brought into the tufting engagement with the looper disposed under said laterally shifted needles to seize only one loop of pile yarn at any one of the needle stroke cycles of each periodic time of a stop and feed motion of said intermittent feed means.

11. A tufting method for producing designs in carpeting using a tufting machine, comprising the steps of laterally shifting needles a distance equivalent to a needle gauge with shift means, said laterally shifted needles each having an associated loop of pile yarn that may be seized therefrom, providing a signal from pattern control means for directing needle select means to select any one of said needles, inserting said needles in said backing fabric during each needle stroke cycle and yet after the step of laterally shifting needles, and seizing only one loop of pile yarn from any one of said needles laterally shifted and disposed over loopers during each periodic time of a stop and feed motion of intermittent feed means by using the loopers to effect the seizing.

12. A tufting method according to claim 11, comprising the steps of threading pile yarns colored in different colors into needles in a manner wherein said pile yarns are composed of several sets of different colors and divided into several groups, each of which being respectively composed of several pile yarns and the number of which being equal to the number of said sets of pile yarn and which varies in color; said pile yarns of each group being arranged in order of said difference of their color in a manner wherein the arrangement of each group is similar to one another; and said arranged pile yarns being respectively threaded into the corresponding needles laterally aligned at the same gauge according to said order of their arrangement in each group, adjusting the number of said needle stroke cycles of each periodic time of a stop and feed motion of said intermittent feed means to be fixed so that said number of said needle stroke cycles of each periodic time becomes equivalent to that of sets of pile yarns, and carrying out tufting in a manner wherein said pattern control means provides said needle select means with a signal adapted to actuate every looper to seize only one loop of pile yarn from one of said needles laterally shifted and disposed over said looper for seizing only one loop of pile yarn in each periodic time of a step and feed motion of said intermittent means.

* * * * *